US005421479A

United States Patent [19]

Noorafshani

[11] Patent Number: 5,421,479

[45] Date of Patent: Jun. 6, 1995

[54] FIRE SAFE AND PROJECTILE RESISTANT CONTAINER

[75] Inventor: Siavash Noorafshani, Templeton, Calif.

[73] Assignee: San Luis Tank Piping Construction Co., Inc., Paso Robles, Calif.

[21] Appl. No.: 216,623

[22] Filed: Mar. 23, 1994

[51] Int. Cl.[6] ..... B65D 90/06

[52] U.S. Cl. ..... 220/571; 220/460

[58] Field of Search ..... 220/571, 426, 452, 460, 220/459

[56] References Cited

U.S. PATENT DOCUMENTS

| | | | |
|---|---|---|---|
| 3,913,822 | 10/1975 | Heaps, Jr. | 220/460 |
| 3,931,908 | 1/1976 | Cheyney | 220/460 |
| 3,987,925 | 10/1976 | Sattelberg | 220/460 |
| 4,537,328 | 8/1985 | Keesee et al. | 220/445 |
| 4,640,439 | 2/1987 | Palazzo | 220/445 |
| 4,676,093 | 6/1987 | Pugnale et al. | 220/426 |
| 4,730,370 | 3/1988 | Elder | 220/460 |
| 4,798,308 | 1/1989 | Nelson | 220/459 |
| 4,979,637 | 12/1990 | Nelson | 220/459 |
| 4,998,970 | 3/1991 | Nelson | 220/457 |
| 5,020,358 | 6/1991 | Sharp | 220/445 |

*Primary Examiner*—Joseph Man-Fu Moy
*Attorney, Agent, or Firm*—Head & Johnson

[57] ABSTRACT

A fire safe and projectile resistant container for storage of fuel or other hazardous liquids having a closed metallic horizontal cylindrical vessel with opposed end walls. Ceramic fiber blanket surrounds and fully encapsulates the horizontal metallic vessel and end walls. The ceramic fiber blanket has a thickness of at least about 4" and is formed of fibers of alumina-silica that occurs naturally as kaolin. The ceramic fiber blanket has a melting point of at least about 3200° F. and a density of 3 to 12 pounds per cubic feet. The vessel encapsulated with the ceramic fiber blanket is supported by spaced apart saddle members. A closed metallic shell surrounds the vessel, the ceramic fiber blanket, and the saddle members and is supported on skids. The ceramic fiber blanket serves to provide fire resistance as well as resistance against penetration of the vessel by pistol or rifle fired projectiles. The shell forms a secondary containment vessel. A conduit communicating between a lower portion of the shell and the exterior thereof provides means for detecting any leakage that might occur from the vessel.

9 Claims, 3 Drawing Sheets

FIRE SAFE AND PROJECTILE RESISTANT CONTAINER

CROSS-REFERENCE TO RELATED APPLICATIONS

This application is not related to any pending patent applications.

CROSS-REFERENCE TO MICROFICHE APPENDIX

This application is not related to any microfiche appendix.

BRIEF SUMMARY OF THE INVENTION

This invention relates to a fire safe and projectile resistant container. More specifically the invention relates to a container that provides a safe storage for fuel or other hazardous liquids.

Many installations require the storage of fuel, or other hazardous liquids, in a manner to guard against inadvertent leakage of the stored liquids to the environment and to guard against rupture of the container and spillage of the contents thereof during fires. A further need is to provide a container for fuel, or other hazardous liquids, that is resistent against projectiles of the type that can be fired from pistols and rifles of the caliber most commonly carried by humans.

To accomplish these objectives, the fire safe and projectile resistant container of this disclosure includes a closed steel vessel that is preferably in the form of a horizontally cylindrical vessel having opposed end walls. The vessel has at least one opening in the top portion of the cylindrical wall for introducing fluid into or removing fluid from the interior of the vessel. The vessel is preferably made of steel that is about ¼" thick or thicker. In the preferred embodiment, the cylindrical wall of the vessel may be formed of a cylindrical shell of ¼" thick steel, while the end walls are of 5/16" steel. The end walls being welded, to the vessel cylindrical wall.

Surrounding the vessel is a ceramic fiber blanket. The fiber blanket encloses the vessel cylindrical walls and end walls and is of a thickness of at least about 4". Preferably, two layers of the ceramic fiber blanket are employed each about 2" thick for a total of about 4". The ceramic fiber blanket is preferably a mat of alumina-silica fibers and most particularly, a mat of kaolin, a naturally occurring clay, and the blanket preferably has a melting point of at least about 3200° F. and a density of 3 to 12 pounds per cubic feet.

Supporting the vessel and ceramic fiber blanket are spaced apart saddle members.

A metallic shell surrounds the vessel, the ceramic fiber blanket, and the saddle members. The metallic shell is preferably of steel of thickness of about 3/16" and is formed in a leak-proof manner so that the outer shell provides a secondary containment system for fluids stored in the vessel.

Skid beams are positioned below the closed metallic shell for supporting the container on a support surface.

A means of detecting leakage of the vessel is preferably included and can be in the form of a conduit having one end that communicates with a lower portion of the interior of the shell and the other end extending externally of the shell providing means for sampling the presence of fluid that may have leaked from the closed vessel into the closed outer shell.

A better understanding of the invention will be obtained from the following detailed description and claims, taken in conjunction with the attached drawings.

DESCRIPTION OF THE PREFERRED EMBODIMENTS

Figure 1:
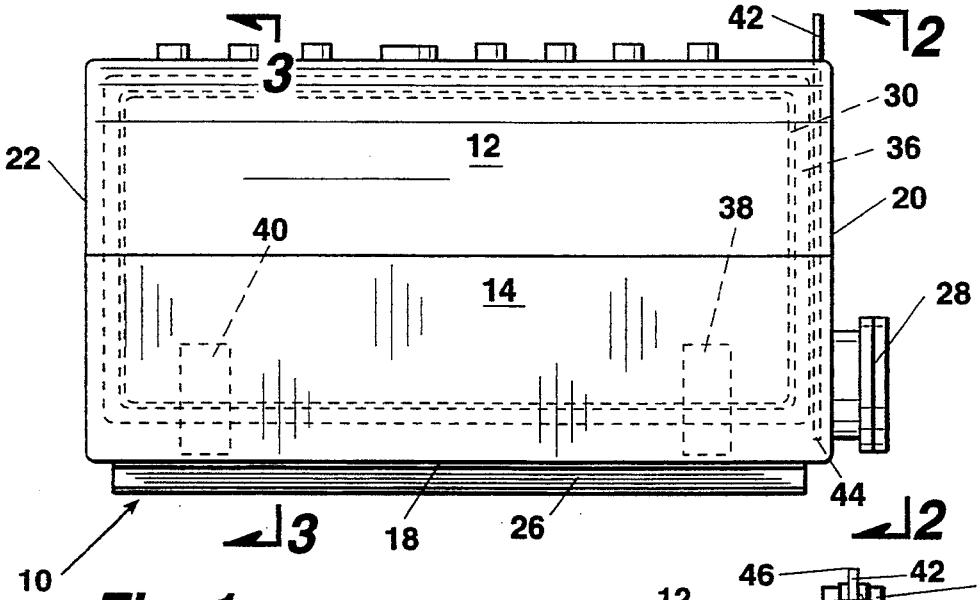
FIG. 1 is an external view of a fire safe and projectile resistant container for the storage of fuel or other hazardous liquids that incorporates the principles of this invention.
Figure 2:
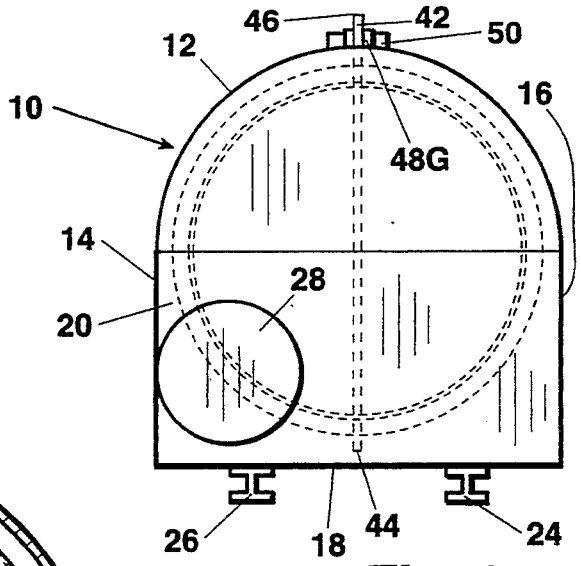
FIG. 2 is an elevational end view of the fire safe and projectile resistant container taken along the line of 2—2 of FIG. 1.

Referring to FIGS. 1 and 2, the external appearance of a first preferred embodiment of the fire safe and projectile resistant container is shown. The container is generally indicated by numeral 10. The primary component, as seen in the external view, is a closed metallic shell that surrounds the interior components of the container. The closed metallic shell has a semi-cylindrical shell top 12, opposed vertical sidewalls 14 and 16, a bottom 18 and end walls 20 and 22.

The container rests on skids 24 and 26.

Formed in shell end wall 20 is a manway opening that is closed by a manway cover 28. By removing manway cover 28, the interior of the shell can be opened to permit visual inspection of the interior components of the container.

Figure 3:
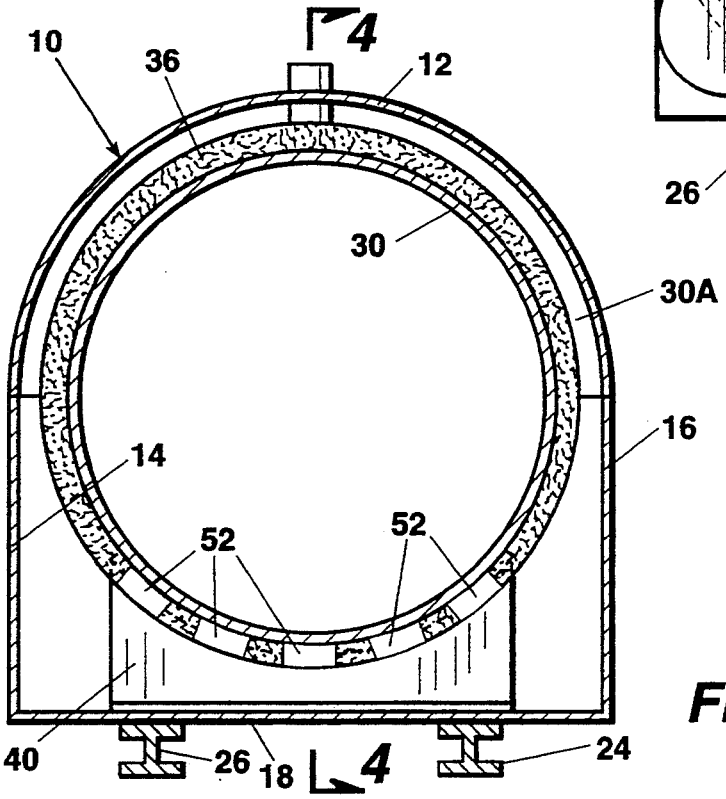
FIG. 3 is an elevational cross-sectional view of the fire safe and projectile resistant container taken along the line 3—3 of FIG. 1.
Figure 4:
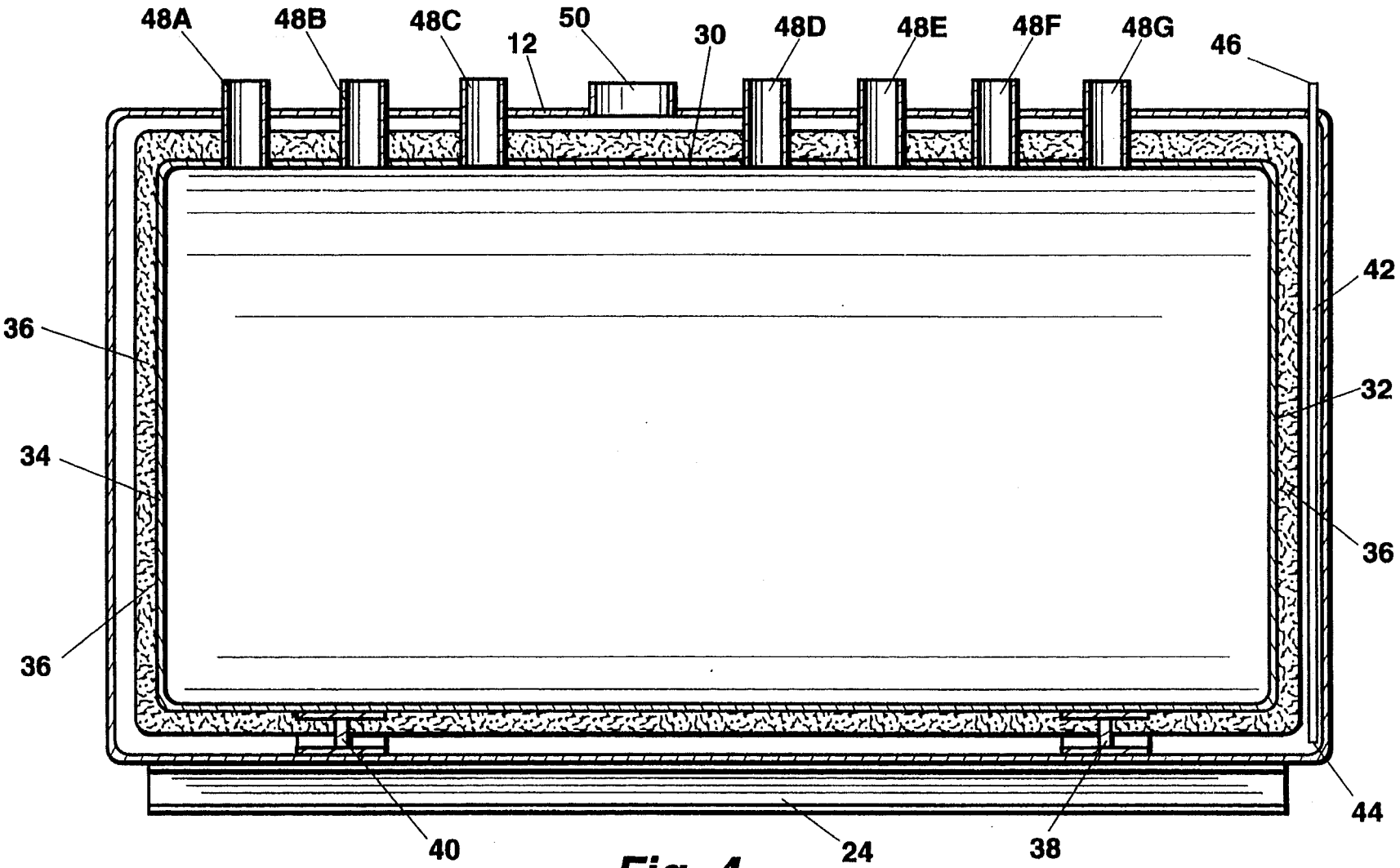
FIG. 4 is an elevational cross-sectional view of the container shown in FIGS. 1 and 3 in enlarged dimension and taken along the line 4—4 of FIG. 3.

Referring now to FIGS. 3 and 4, interior details of container 10 are shown. Positioned within the container is a cylindrical closed vessel formed by a cylindrical sidewall 30 having end walls 32 and 34. The vessel is preferably made of steel and in a preferred arrangement, is formed of a cylindrical horizontal sidewall 30 to which is welded opposed ends 32 and 34 which may be in the form of flange flat heads. In the preferred practice of the invention, the vessel cylindrical sidewall 30 is of steel of at least about ¼" thickness, while end walls 32 and 34 are preferably formed of flange flat heads of at least about 5/16" thickness and welded to cylindrical sidewall 30.

Surrounding the vessel is a ceramic fiber blanket 36, that is, the ceramic fiber blanket 36 surrounds the entire surface area of the vessel, including cylindrical wall 30 and end walls 32 and 34. The ceramic fiber blanket is preferably formed of a mat of alumina-silica fibers of about 4" thickness. Most preferably, the blanket is formed of two layers each about 2" thick for a total thickness of 4". The ceramic fiber blanket has a melting point of at least about 3200° F. and a density of 3 to 12 pounds per cubic feet. In a still more preferred embodiment, fiber blanket 36 is formed of fibers derived from kaolin, a naturally occurring clay having the formula $Al_2Si_2O_5(OH)_4$. The material of which the ceramic fiber blanket 36 is formed is commercially available from Thermal Ceramics, P.O. Box 923, Augusta, Ga. 30903-0923 and is sold by this company under their trademark "KAOWOOL". The "KAOWOOL"® blanket meets the requirements specified hereinabove, that is, it is a thermal ceramic blanket produced from kaolin, a naturally occurring alumina-silica fire clay. The blanket is formed from alumina-silica fibers that are air-layed into a continuous mat and mechanically needled to provide tensile strength and surface integrity. The "KAOWOOL" ® blanket has a density that varies from 3 to 12 pounds per cubic feet and is available in the required thickness of about 2". Two 2" layers are used so that the total thickness of the blanket is about 4". This material has a maximum temperature rating of about 2300° F., a melting point of 3200° F. and a continuous use up to 2000° F.

The ceramic fiber blanket covered vessel 30A is supported by saddle members 38 and 40.

The vessel 30A, ceramic fiber blanket 36, and saddle members 38 and 40 are encompassed by the shell previously described. That is, the shell made up of top 12, sidewalls 14 and 16, bottom 18 and end walls 20 and 22. The shell thus forms an exterior secondary containment vessel to entrap and contain liquids that could inadvertently leak from vessel 30A to thereby provide a safe means of storing fuels or other hazardous liquids.

As seen in FIG. 4, a leak detector system is provided in the form of a conduit 42 having a first end 44 that is positioned adjacent to the interior bottom of the shell and a second opening 46 that is exterior of the shell. In the arrangement of conduit 42, as shown in FIG. 4, the conduit extends vertically and centrally of one end of the container. The first end 44 terminates adjacent to the interior bottom of the shell and the conduit extends through the shell and extends above the shell top, as seen in FIG. 2. The second opening 46 can extend to a leak detection system, such as a device for applying vacuum to the tube so that any liquid which collects within the interior lower bottom portion of the shell will be withdrawn through conduit 42 to thereby provide an indication that leakage is occurring. Conduit 42 could extend exteriorly of the vessel in other ways. The most important function of the conduit is to provide a means of sampling for leakage that might occur that permits fluid from the interior of vessel 30A to leak into the containment shell.

As shown in FIGS. 1 and 4, a plurality of short-length conduits 48A through 48G communicate with the vessel tubular sidewall at the top thereof. These conduits are shown open but in actual practice, these conduits will be closed by flanges or by fittings that provide communication whereby liquids can be delivered into or extracted from the vessel. To extract liquid from the vessel, a discharge pipe (not shown) can extend through one of the conduits 48A through 48G to adjacent the bottom interior of the vessel.

A larger diameter inspection conduit 50 is provided in the shell top wall 12 as to provide inspection. This inspection conduit can be used in the same manner as the passageway covered by manway cover 28 previously described to permit inspection of the interior of the shell.

Figure 5:
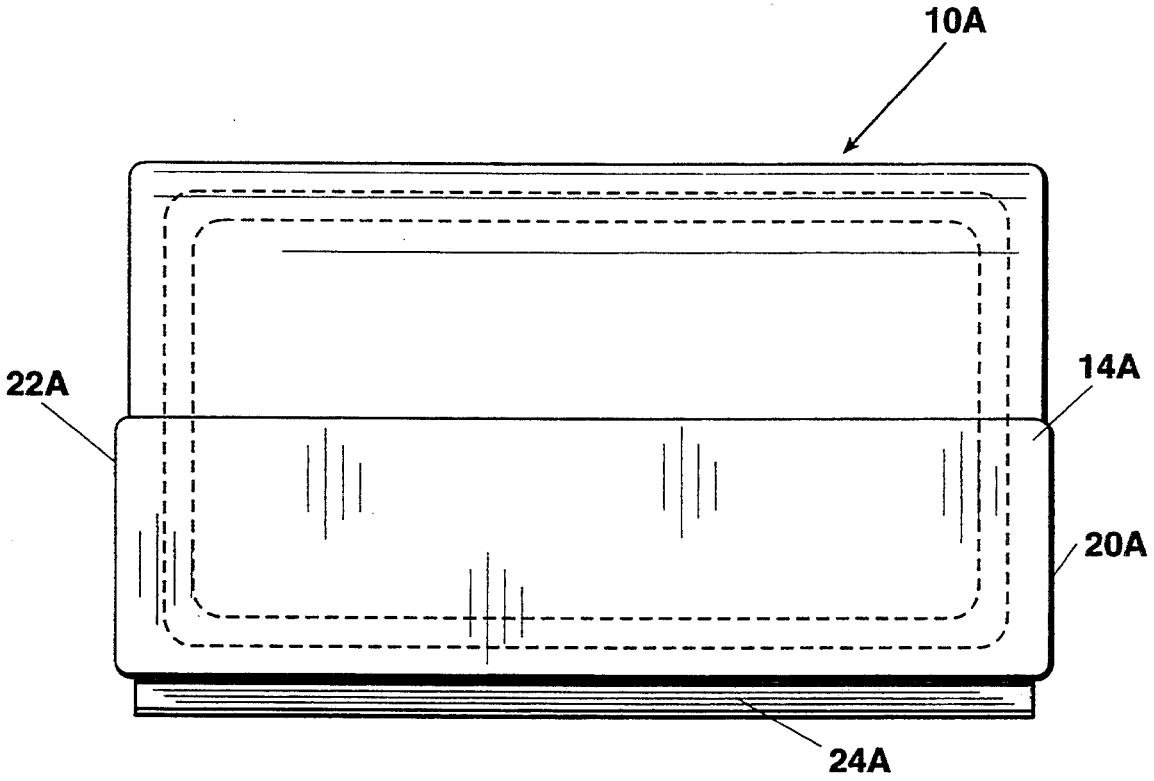
FIG. 5 is a elevational view of an alternate embodiment of the fire safe and projectile resistant container.
Figure 6:
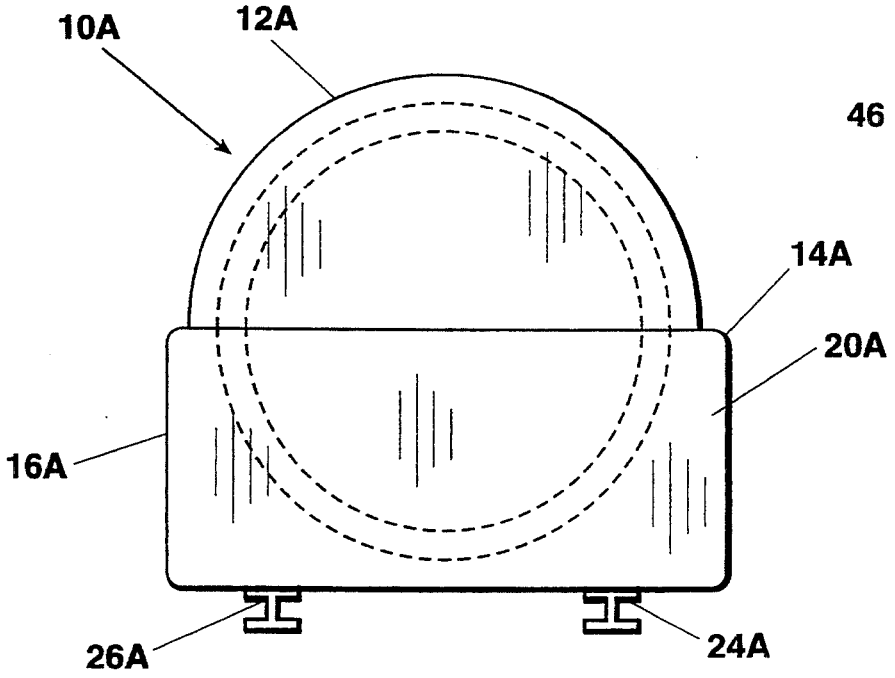
FIG. 6 is a end view of FIG. 5.

FIGS. 5 and 6 show an alternate arrangement of the invention wherein the shell cylindrical top 12A is of some smaller diameter than the width of the shell end walls 20A and 22A, and the shell lower sidewalls 14A are somewhat longer than the shell semi-cylindrical top 12A. Other than the different shape of the shell, the container 10A, as shown in FIGS. 5 and 6, is substantially the same in every respect to that as has been described with reference to FIGS. 1 through 4. That is, the shell contains a horizontal cylindrical sidewall vessel with closed ends fully encapsulated by a ceramic fiber blanket and supported on saddle members. The container 10A of FIGS. 5 and 6 is supported on skids 24A and 26A, as described with reference to skids 24 and 26.

Although not illustrated, the embodiment of FIGS. 5 and 6 can include an inspection conduit to provide means for detecting leakage from the vessel that may occur within the enclosed shell. Further, FIGS. 5 and 6 would typically be provided with access conduits and inspection conduits, as previously described.

The container herein described has several advantages over the typical fuel storage tank that is employed at the present time in industry. First, the provision of the external shell provides a secondary containment system so that in the event of leakage of the primary vessel, the leaked liquid will be contained and prevented from escaping into the environment. Second, the secondary containment system provides a means of detecting such leakage so that preventative action can be taken before damage is done to the environment. Third, the container, as above described, has a high fire safety rating, meaning that it can withstand a typical fire environment for two hours before the integrity of inner vessel 30A would be damaged to the point that escape of fuel or other contaminates to the environment would occur. This is achieved primarily by the provision of a strong steel vessel 30A and the ceramic fiber blanket 36 combined with the encapsulating shell. To achieve this favorable result, the prescribed characteristics of the surrounding fiber blanket are critically important, as well as the thickness thereof.

Please refer back to FIG. 3, to support vessel 30A on saddles 28 and 40, blocks 52 are used. Blocks 52 are spaced apart from each other and prevent squeezing ceramic fiber blanket 36. Blocks 52 can be formed of a fire resistant material, such as various ceramic materials. One material that is useful in making blocks 52 is calcium aluminate cement such as that sold by Thermal Ceramics of Augusta, Ga. under their registered trademark KAOCRETE ®.

A fourth safety feature of the device is that it is projectile resistant. This means that a projectile fired from a pistol or rifle of the caliber and size normally carried by humans, such as hunting rifles and so forth, is effectively resisted by the container. The encapsulation of vessel 30A with the blanket of ceramic fiber produces a surprisingly effective projectile resistant combination. The ceramic fiber blanket effectively absorbs the impact of a pistol or rifle fired projectile, enabling the steel vessel to absorb the impact without resulting in penetration and thereby leakage of fluid from the vessel.

The claims and the specification describe the invention presented and the terms that are employed in the claims draw their meaning from the use of such terms in the specification. The same terms employed in the prior art may be broader in meaning than specifically employed herein. Whenever there is a question between the broader definition of such terms used in the prior art and the more specific use of the terms herein, the more specific meaning is meant.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. A fire safe and projectile resistant container for storage of fuel or other hazardous liquids comprising:

a closed metal vessel having a horizontally positioned cylindrical wall and opposite end walls and having at least one opening in a top portion of the cylindrical wall for introducing fluid into or removing fluid from the vessel;

a ceramic fiber blanket surrounding and enclosing said vessel cylindrical wall and end walls of a thickness of at least about 4", the ceramic fiber blanket having a melting point of at least about 3200° F. and a density of 3 to 12 pounds per cubic foot;

spaced apart saddle members supporting said vessel; and a closed metallic shell surrounding said vessel, said ceramic fiber blanket, and said saddle member.

2. A fire safe and projectile resistant container according to claim 1 including:

skid beam means positioned below said closed metallic shell for supporting the container on a support surface.

3. A fire safe and projectile resistant container according to claim 1 wherein said vessel is of steel of at least about ¼" thickness.

4. A fire safe and projectile resistant container according to claim 1 wherein said shell is of steel of at least about 3/16" thickness.

5. A fire safe and projectile resistant container according to claim 1 wherein said ceramic fiber blanket is in the form of a mat of alumina-silica fibers.

6. A fire safe and projectile resistant container according to claim 5 wherein said ceramic fiber blanket is formed of kaolin.

7. A fire safe and projectile resistant container according to claim 1 including means for detecting leakage of liquid from said vessel into said shell.

8. A fire safe and projectile resistant container according to claim 7 wherein said means for detecting leakage of liquid from said vessel into said shell includes a conduit having one end in communication with a bottom interior portion of said shell and the exterior thereof.

9. A fire safe and projectile resistant container according to claim 1 including a plurality of spaced apart blocks positioned between said vessel and said saddle members to prevent squeezing said ceramic fiber blanket at said saddle members.

* * * * *